United States Patent [19]

Parker et al.

[11] Patent Number: 5,016,879

[45] Date of Patent: May 21, 1991

[54] PACHINKO GAME

[75] Inventors: J. J. Parker; Sandy Tiedeman; William J. Baugh, all of Las Vegas, Nev.

[73] Assignee: James and Rosemarie Parker Family Trust, Las Vegas, Nev.

[21] Appl. No.: 447,686

[22] Filed: Dec. 8, 1989

[51] Int. Cl.[5] ..... A63F 3/00

[52] U.S. Cl. ..... 273/126 A; 273/138 A; 273/121 B

[58] Field of Search ..... 273/1, 108, 113, 115, 273/118 R, 120 R, 120 A, 121 A, 121 B, 123 R, 123 A, 126 R, 138, 143

[56] References Cited

U.S. PATENT DOCUMENTS

| | | | |
|---|---|---|---|
| 426,546 | 4/1890 | Reed | 273/123 R |
| 524,475 | 8/1894 | Wheeland . | |
| 1,181,027 | 4/1916 | Mannhardt | 273/123 R |
| 1,520,345 | 12/1924 | Hamilton | 273/108 |
| 1,947,772 | 2/1934 | Harris | 273/138 |
| 2,614,840 | 10/1952 | Monkres | 273/121 A |
| 2,732,210 | 1/1956 | Heide | 273/121 A |
| 3,531,114 | 9/1970 | Parks et al. | 273/1 |
| 3,807,736 | 4/1974 | Goldfarb et al. | 273/123 R |
| 3,825,265 | 7/1974 | Pitkanen et al. | 273/121 B |
| 4,055,344 | 10/1977 | Soucie | 273/123 R |
| 4,508,336 | 4/1985 | Yokoi | 273/1 |

FOREIGN PATENT DOCUMENTS

| | | | |
|---|---|---|---|
| 0189256 | 7/1986 | European Pat. Off. | 273/143 R |
| 2359603 | 6/1974 | Fed. Rep. of Germany | 273/126 R |
| 3220395 | 12/1983 | Fed. Rep. of Germany | 273/143 R |

*Primary Examiner*—Edward M. Coven
*Assistant Examiner*—Raleigh W. Chiu
*Attorney, Agent, or Firm*—Quirk, Tratos & Roethel

[57] ABSTRACT

A playing field has a plurality of pachinko mazes arranged side by side. Each pachinko maze has a scoring slot at the bottom of the maze. When each playing disk falls into a particular scoring slot, the value of the slot is determined. The value of each scoring slot is changed from game to game by means of a random electronic program so that different winning values occur. In one version of the game, the playing field comprises three parallel pachinko mazes and a disk is dropped into one of each of the pachinko mazes. Each pachinko maze has six scoring slots at the bottom thereof. At the beginning of each game, each scoring slot has one of three possible symbols illuminated—cherries, plum or jackpot. The player wins preselected amounts depending on which combinations of symbols the three playing disks fall into. In another version of the game, eleven playing disks are dropped into eleven parallel pachinko mazes, each maze having only two scoring slots—designated "left" or "right". Prior to the disks being dropped, an indicator light activates either the right side slot or the left side slot in each maze for that particular game. The player wins predetermined amounts if the disks land in at least a predetermined number of the illuminated slots.

118 Claims, 7 Drawing Sheets

PACHINKO GAME

This application contains a first Appendix A comprising a listing of the Source Code and Programmers Comments for an exemplary computer program to control the MULTI-SYMBOL MATCH 'EM pachinko game of the present invention. This application also contains a second Appendix B comprising a listing of the Source Code and Programmers Comments for an exemplary computer program to control the LEFT-RIGHT MATCH 'EM pachinko game of the present invention.

BACKGROUND OF THE INVENTION

1. Field of the Invention

This invention relates to a pachinko game, and more particularly to a pachinko game in which the values of the scoring slots change with each game.

2. Description of the Prior Art

The game of the present invention is based on the well-known game that normally goes by the name of pachinko. Pachinko involves a vertical playing field that has a glass cover plate and a solid back wall. A plurality of deflection pins or pegs extend at right angles from the back wall to the glass cover plate. A disk, coin, token, ball or other scoring device is dropped through a slot at the top of the playing surface and bounces back and forth between the deflection pins as it falls toward the bottom of the playing surface. Along the bottom of the playing surface are a plurality of scoring slots. The player scores points corresponding to the value assigned to the particular scoring slot in which the falling disk ultimately comes to rest.

A typical version of pachinko is shown in U.S. Pat. No. 524,475 (Wheeland), which patent was granted in 1894. This patent in fact is directed at an improvement to the game of pachinko in which the deflection pins or pegs are made of a spring material to give the falling disk an even more random travel path. Another example of a pachinko game is shown in U.S. Pat. No. 1,947,772 (Harris).

While pachinko is quite appealing to people who like to play games because of the apparently random movement of the disk as it bounces off the deflection pins and because it is possible through the glass to watch the fall of the disk, it has proven difficult to adopt pachinko to a casino gaming environment. Gaming regulators require any gaming device to result in a random determination of winning and losing events. In a pachinko game, the final destination of the falling disk is determined by the location of the deflection pins.

Even if the deflection pins are positioned in such a manner to make the disk fall as randomly as possible, the falling disk will still more often fall toward the middle of the scoring area than toward the outer ends. Older versions of pachinko attempted to adjust for this probability by making the scoring slots on the outer edges of the scoring area have a higher value than the scoring slots toward the center of the scoring area. Representative of this scoring value adjustment is the patent to Wheeland which shows the end scoring slots having a value of 5 whereas the scoring slots in the center have a value of 0, 1 and 0, respectively.

It is possible to bias the outcome of the game by positioning the deflection pins in a particular way to favor one scoring slot over the other scoring slots. It is also possible to bias the game by externally tipping the gaming device slightly by placing a wedge or shim under a leg or other support of the game. Any game that is easily "gaffed" (i.e. modified to favor the player or the house) will not be approved for use in legalized gaming establishments.

OBJECTS, FEATURES AND ADVANTAGES OF THE INVENTION

It is an object of the present invention to provide a pachinko game method and apparatus which is sufficiently random to meet the requirements for use in a casino gaming environment.

It is a feature of the present invention to change the value of the scoring slots for each game that is played. This changing of the value of the scoring slots is effected by electronically varying the scoring value for each slot from game to game.

It is an advantage of the present invention that the game of pachinko becomes a random game and the player will not know what the value of any particular scoring slot is until the disk begins to fall through the playing field.

SUMMARY OF THE INVENTION

A playing disk is dropped into a pachinko maze in the playing field of a pachinko game. Each playing field has a plurality of pachinko mazes arranged side by side. Each pachinko maze has a scoring slot at the bottom of the maze. When each playing disk falls into a particular scoring slot, the value of the slot is determined. The value of each scoring slot is changed from game to game by means of a random electronic program so that different winning values occur.

In one embodiment of the present invention, referred to as MULTI-SYMBOL MATCH 'EM, the playing field comprises three parallel pachinko mazes and a disk is dropped into one of each of the pachinko mazes. Each pachinko maze has six scoring slots at the bottom thereof. Prior to the disks being dropped at the beginning of each game, one of three possible symbols—"cherries", "plum" or "100" jackpot—is activated for each scoring slot for that particular game by illuminating one of the symbols. The player wins preselected amounts depending on which combinations of symbols the three disks fall into.

In another embodiment of the present invention, referred to as LEFT-RIGHT MATCH 'EM, eleven playing disks are dropped into eleven parallel pachinko mazes, each maze having only two scoring slots—designated "left" or "right". Prior to the disks being dropped, an indicator light activates either the right side slot or the left side slot in each maze for that particular game. The player wins predetermined amounts if the disks land in at least a predetermined number of the illuminated slots.

The game can be played as an amusement device in which the player accumulates points toward a final score. If it is desired to use the gaming apparatus as a game of chance in which the coins or tokens have monetary value, the points or score that the player achieves can also have monetary value.

DETAILED DESCRIPTION OF THE PREFERRED EMBODIMENTS

Figure 1:
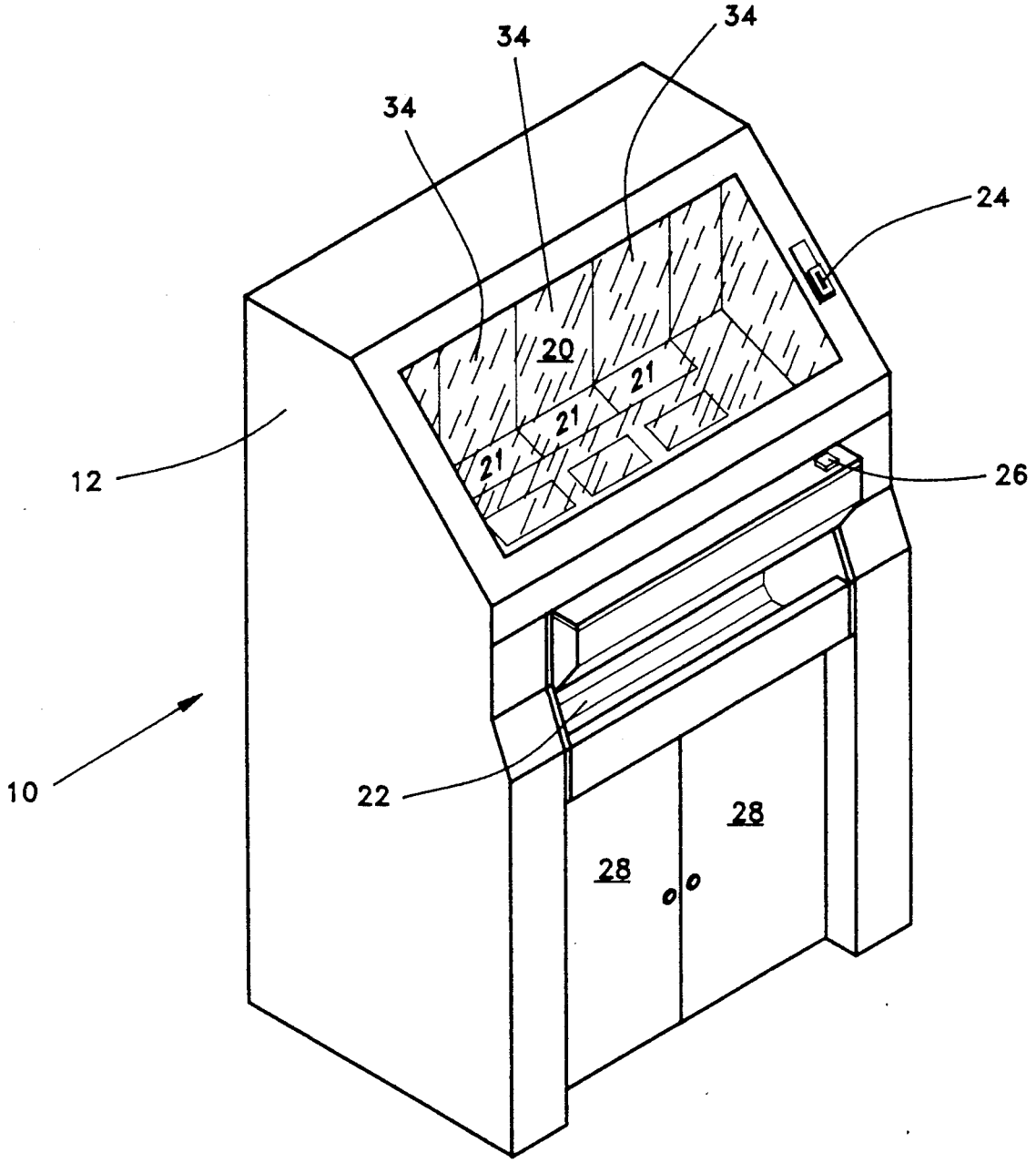
FIG. 1 shows a perspective view of the gaming machine apparatus used to play the MULTI-SYMBOL MATCH 'EM pachinko game of the present invention.

The gaming machine apparatus used to play the MULTI-SYMBOL MATCH 'EM pachinko game of the present invention is shown generally at 10 in FIG. 1. The apparatus comprises a generally upright cabinet 12, the approximate upper half of which houses the playing field 20 and a symbol display area 21 providing playing information to the player. Below the playing field 20 and symbol display area 21, there is provided a coin tray 22 into which the coins or tokens are dispensed whenever the player wins. Below the coin tray 22, two lockable doors 28 conceal the lower internal area in the machine where coins or tokens that have been wagered are stored for removal at a later time. The internal area of the machine also houses the electronic apparatus necessary to operate the game as well as other mechanical apparatus, such as the coin acceptor and the coin hopper, conventionally found in gaming devices.

At an appropriate location on the apparatus, a coin acceptor 17 (the coin slot 24 of which is shown in FIG. 1) is provided to receive the coins or tokens that players insert to activate the game. Also at an appropriate location on the apparatus there is provided a start button 26 that is pressed by the player to start the game after the coins or tokens are put into the coin acceptor.

Figure 2:
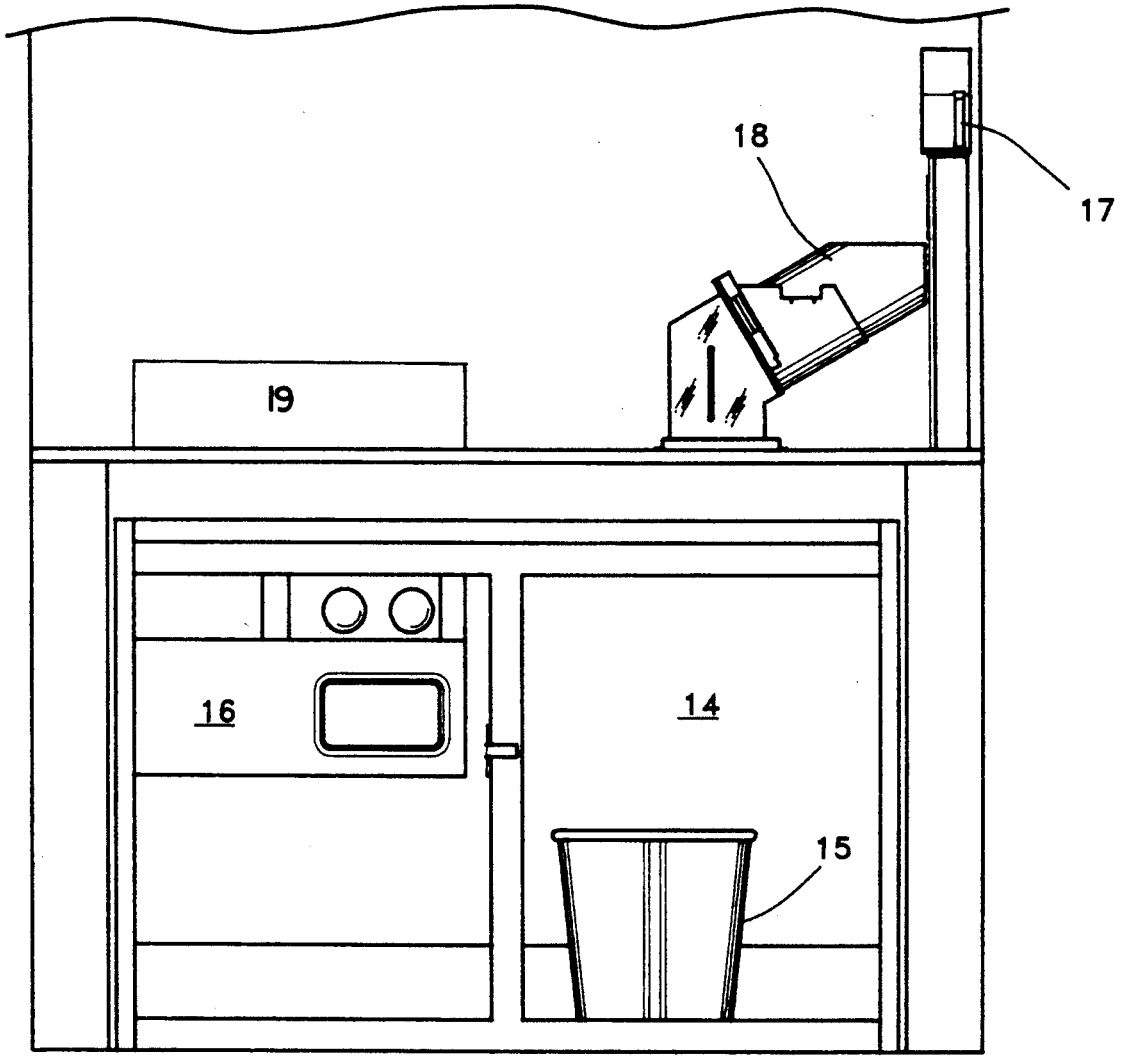
FIG. 2 shows a partial view of the interior of the gaming machine apparatus used to play the MULTI- SYMBOL MATCH 'EM pachinko game of the present invention.

As shown in FIG. 2, behind the lockable doors 28 of the lower interior of the gaming machine apparatus 10 is a coin drop area 14 that contains a bucket 15. To the left of the coin drop area 14 there is provided a power supply 16 and an electronic control panel 19 on which are mounted some of the computer controls that operate the game and provide the electronics necessary to randomly determine the outcome of the game.

Just above the coin drop area 14 is mounted the coin acceptor 17 and the coin hopper 18. The coin acceptor 17 is positioned inside the machine 10 so that it cooperates with the coin acceptor slot 24 on the outside of the machine. The coin acceptor can be any conventional coin acceptor such as Model No. CC-40-A, made by Coin Mechanisms, Inc., Chicago, Ill.

After a coin or token is deposited into the coin acceptor 17, it passes from there into the coin hopper 18 where it is available for making payoffs to the player. The coin hopper can be any conventional coin hopper such as Model No. 11-031-107, made by Mills-Jennings Co., Reno, Nev. When the coin hopper becomes too full, coins overflow into the coin drop area where they fall into the bucket 15. The coins in the bucket 15 are removed periodically by casino personnel.

Figure 3:
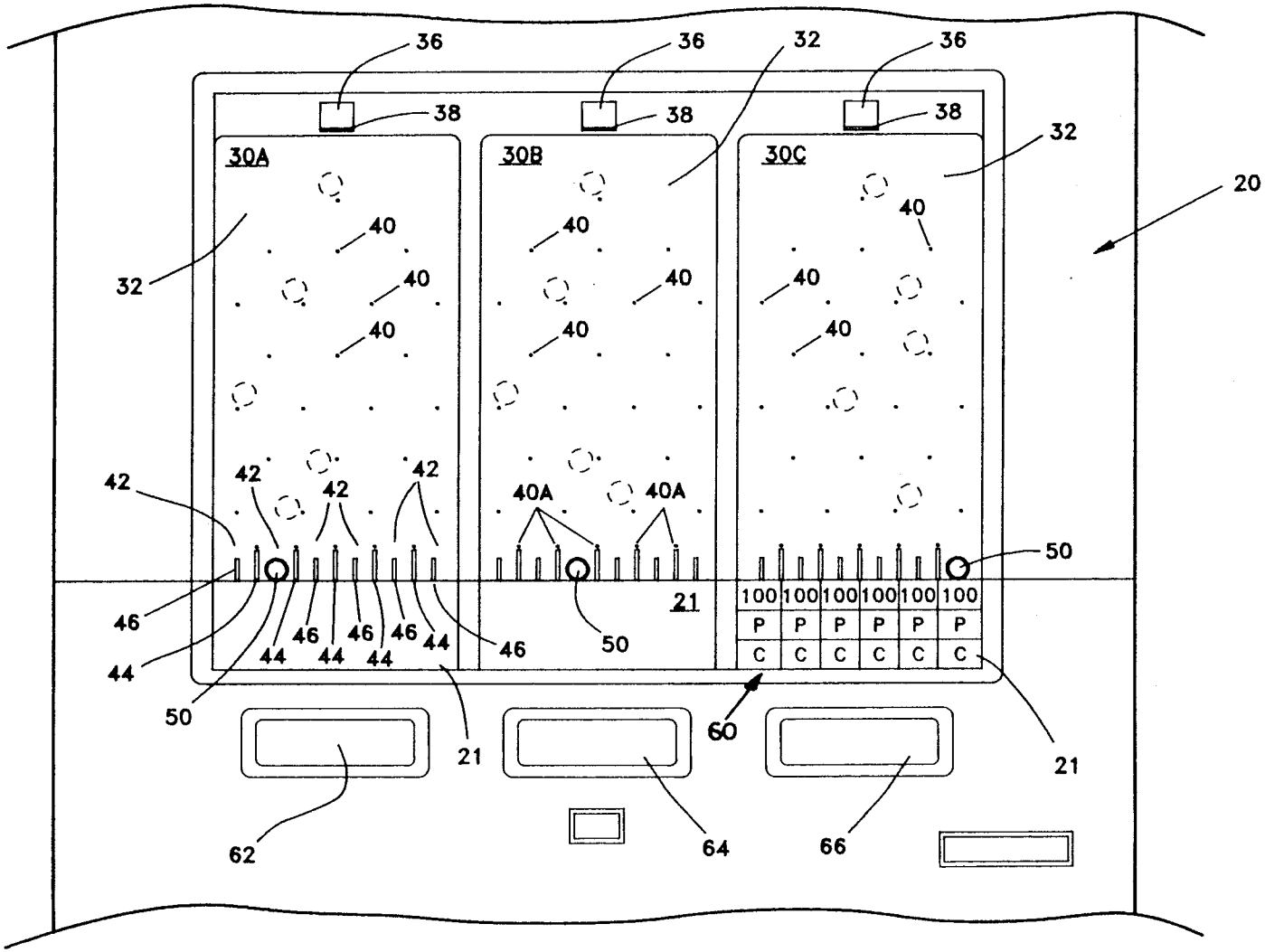
FIG. 3 shows a front view of the playing field of the MULTI-SYMBOL MATCH 'EM pachinko game of the present invention.

The playing field and display area 20 are more clearly shown in FIG. 3. In this embodiment of the invention, the playing field has three identical pachinko mazes 30A, 30B and 30C side by side, only one of which will be described. Each pachinko maze 30 has a back wall 32 of preferably opaque material. Parallel to the back wall 32 is a preferably transparent front wall (shown at 34 in FIG. 1) which allows the player to observe the fall of a playing disk 50. The playing disk 50 is preferably approximately one inch in diameter and has a thickness of approximately ¼ of an inch, but there is nothing critical about the size or shape of the playing disk 50. For example, while the game will be described using playing disks, it is also possible to use other shapes of falling objects such as balls. The disk can be made of any suitable material such as metal or plastic.

At the top of each pachinko maze 30, an opening 36 is provided through which the playing disk 50 is introduced into the pachinko maze. At the lower end of each opening 36, there is provided a horizontally movable ledge member 38 upon which the playing disk 50 rests before the game is begun.

A plurality of deflection pins 40 or pegs are disposed between the back wall 32 and the front wall 34, each pin 40 being of a length approximately equal to the width between the back wall 32 and the front wall 34. The width between the back wall 32 and the front wall 34 should be generally only slightly more than the thickness of the playing disk 50.

At the lower end of each pachinko maze 30, a plurality of vertically disposed scoring slots 42 are provided. In the prefered embodiment six slots 42 are provided, but the number of slots may be more or less than six. The scoring slots are separated from one another by vertical spacers 44, each of which has a deflection pin 40A immediately adjacent the upper end of the vertical spacer 44. The deflection pin 40A protects the vertical spacer 44 from wear and tear that would be encountered from the falling playing disk 50. The vertical spacers 44 demarcate and separate the scoring slots 42 from each other.

As is conventional in a pachinko game, when the playing disk 50 is introduced into the pachinko maze, the playing disk 50 falls by gravity and bounces back and forth due to the playing disk 50 colliding with the deflection pins 40. Eventually the playing disk 50 will come to rest in one of the scoring slots 42. A mechanical trip lever 46 is provided in each scoring slot 42 so that as the playing disk 50 passes into a particular slot 42, the mechanical trip lever 46 will be forced downwardly which will electronically send a signal to the electronic computer control indicating which scoring slot 42 the playing disk 50 has fallen into. In the preferred embodiment, the movement downwardly of trip lever 46 allows an optical beam to pass to a sensor to provide the electronic signal, but other appropriate means can be used to effect the electronic signal.

Adjacent to each scoring slot 42 in the display area 21, value symbols 60 are shown which will identify the value of each scoring slot 42 during the play of a particular game. In this preferred embodiment of the present invention, each scoring slot 42 has adjacent thereto a "100 " jackpot symbol, a "plum" symbol and a "cherries" symbol. (In FIGS. 3 and 4, the "100 " jackpot symbol is represented by the number "100", the "plum"

symbol is represented by the letter "P" and the "cherries" symbol is represented by the letter "C".)

Below the value symbols 60 in the display area 21 are three information blocks 62, 64 and 66 advising the player which combinations of symbols win what amounts. In this preferred embodiment, the amounts that the player may win depends on how many coins or tokens he may have bet. This is known as a "buy" game because the player has the option of "buying" higher potential payoffs by betting more coins or tokens. For example, the amounts that a player can win are shown in the following schedules:

| symbol combination | # of tokens returned to player |
|---|---|
| I. (Information block 62) Player wagers one token: | |
| two "cherries" | 2 |
| three "cherries" | 9 |
| II. (Information block 64) Player wagers two tokens: | |
| three "plum"s | 17 |
| III. (Information block 66) Player wagers three tokens: | |
| three "100" jackpots | 100 |

The payoffs are cumulative, not exclusive; that is, a three token bet is considered to also activate the one token and two token payoffs and allows the player to win if he achieves two "cherries", three "cherries", three "plums" or three "100" jackpots. Similarly, a two token bet is considered to also activate the one token payoff and allows the player to win if he achieves two "cherries", three "cherries" or three "plums".

Figure 4:
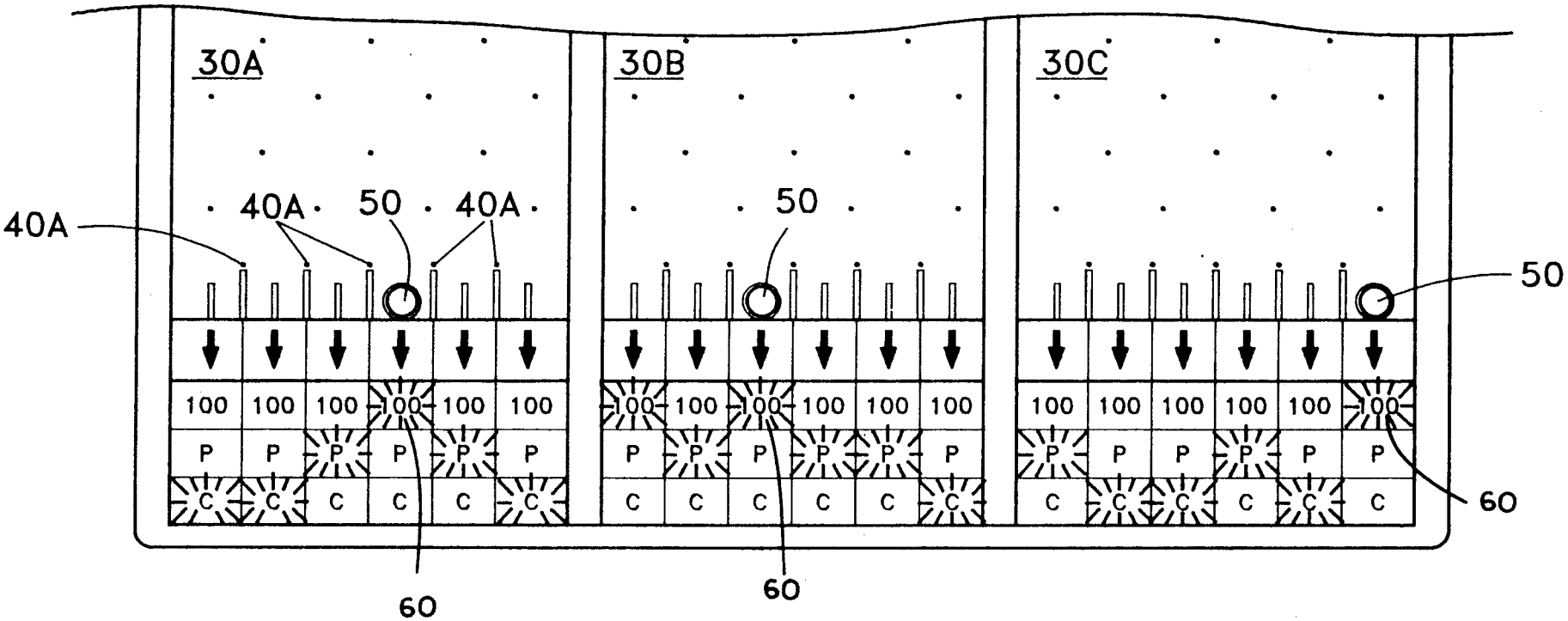
FIG. 4 shows in detail the display area for the value symbols used in the MULTI-SYMBOL MATCH 'EM pachinko game of the present invention.

Prior to the playing disks 50 beginning to fall, one of the scoring symbols 60 associated with each scoring slot 42 is selected to be the value of that scoring slot 42 for that particular game. This selection is done randomly using an electronic control system which will be explained in detail below. The player is apprised of which of the "cherries", the "plum" or the "100" jackpot is active for each scoring slot 42 by the illumination of one value symbol 60 adjacent each slot. As shown in FIG. 4, the value symbol 60 for the "100" jackpot is shown as illuminated adjacent to the scoring slot 42 in which each playing disk 50 has fallen. Thus, as shown in FIG. 4, the player will have won $100 if the player had wagered three dollars prior to activating the fall of the playing disks 50.

In the preferred embodiment of this invention, each value symbol 60 is mounted on a translucent panel over a small light bulb. As will be explained with reference to the electronic control system, the light bulbs are sequentially activated before the fall of the playing disks 50 so that the value symbols 60 are made to flash on and off. When the player activates the game by pushing the start button 26, the value symbols 60 stop flashing and the scoring values available for each scoring slot 42 for that particular game are indicated by a solid illuminated value symbol 60 adjacent each scoring slot 42. In the most preferred embodiment, when a playing disk 50 comes to rest in a particular scoring slot 42, the light bulb illuminating that scoring slot 42 will again be caused to flash on and off to alert the player to the particular scoring value that the playing disk 50 has achieved. This will make it very easy for the player to determine whether he has won or lost. The payout of winning coins is made automatically regardless of whether the player recognizes that he has achieved a winning combination.

Figure 5:
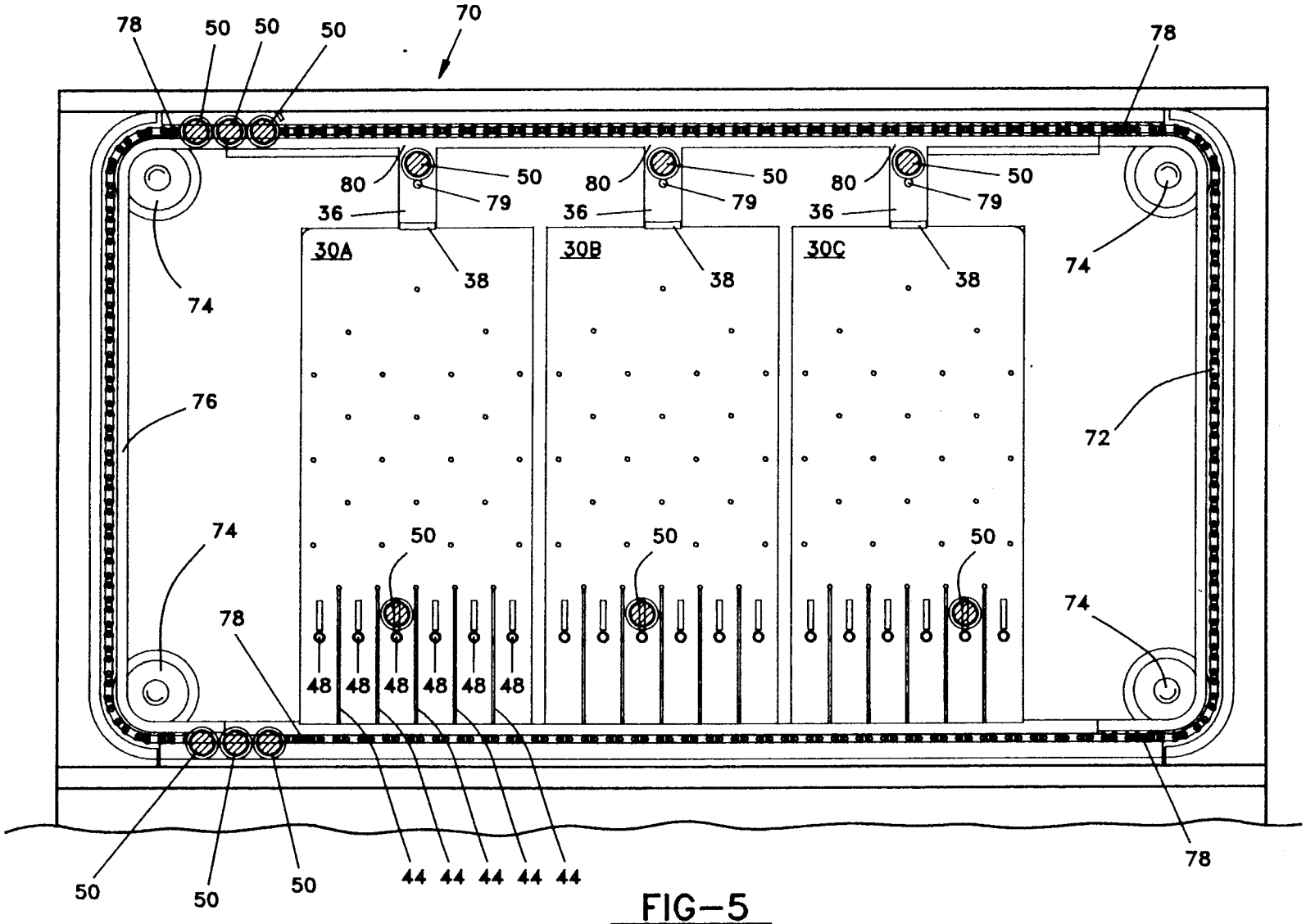
FIG. 5 shows a view of the disk moving system that transfers the playing disks through the gaming machine apparatus of the MULTI-SYMBOL MATCH 'EM pachinko game of the present invention.

FIG. 5 shows the portions of the gaming apparatus that physically move the playing disks 50 from the bottom to the top of each pachinko maze 30. The disk moving system 70 comprises a chain link 72 disposed around four pulley wheels 74. Surrounding the chain link 72 is a track 76 that holds the playing disks 50 in place next to the chain link 72 as they move around the apparatus. At the bottom of each pachinko maze 30, the vertical spacers 44 extend downwardly to the proximity of the track 76 to guide the playing disks 50 into operative relationship with the track 76. Just below the trip lever 46 in each scoring slot 42, there is provided a horizontally movable stop peg 48 that initially limits the fall of the playing disk 50. This stop peg 48 can be slid inwardly to allow the playing disk 50 to fall to the bottom of the scoring slot 42 into the track 76. At appropriate points along the length of the chain link 72, posts 78 are mounted on the chain link 72 to force the playing disks 50 in the track 76 to move when the chain link 72 is moved by the pulley wheels 74. A motor (not shown) is connected to at least one of the pulley wheels 74 to cause movement of the chain link 72.

In the operation of the game, the player inserts one, two or three tokens into the coin acceptor slot 24. When the first token is introduced into the coin acceptor 17, a sensor in the coin acceptor 17 sends a signal through the electronic control to a conventional random number generator (RNG). The RNG has a plurality of numbers which are assigned to each of the value symbols 60. The RNG has been continuously cycling through the possible number combinations, and when the RNG receives the signal from the coin acceptor 17, the RNG sends a signal to the symbol display area 21 to identify which of the three possible value symbols 60 will be active in each scoring slot 42 for that particular game. When the player has completed entering the number of tokens he wishes to wager for that particular game and the player pushes the start button 26, the active value symbol 60 for each scoring slot 42 is illuminated. (Alternatively, and as is conventional in many electronic gaming devices, when the player has inserted the maximum number of coins, in this case three, the game is begun automatically without the necessity of the player manually pressing the start button 26.)

Also when the first token is deposited in the coin acceptor 17, the playing disks 50 from the previous game are ejected from the scoring slots 42. This is accomplished by having a signal sent from the coin acceptor 17 through the electronic controls to the disk moving system 70. A switch causes the peg 48 to move inwardly allowing the playing disk 50 in each scoring slot to fall, guided by the vertical spacer 44, down to the track 76 and into operative relationship with the chain link 72. The motor is started which causes the pulley wheels 74 to rotate causing the chain link 72 to move in a clockwise direction as shown in FIG. 5. As the chain link moves clockwise, a post 78 will engage the edge of playing disk 50 and push the playing disk 50 along the track 76. As the playing disks 50 move along the track, they will eventually reach the entry passageways 80 which leads to the opening 36 in the top of each pachinko maze 30. A playing disk 50 will fall into each entry passageway 80 where it will be held by another horizontally movable peg 79 until the next game is activated.

When the next game is activated, and at the same time that pegs 48 are activated to drop the playing disks 50, pegs 79 also are activated which drops the other playing disks 50 down into the opening 36 at the level of the movable ledge 38 where the playing disks 50 are held until it is time for the playing disks to be dropped for movement through the pachinko maze 30. The number of disks used in the apparatus will determine how far the chain link has to move and how far apart the posts 78 need to be spaced in order to ensure that each opening 36 has a playing disk 50 at the time the next game is activated. In the preferred embodiment of the present invention, twelve playing disks 50 are used in the apparatus so that there is always a playing disk 50 in the opening 36 ready to be dropped at the top of each of the pachinko mazes 30.

When the start button 26 is activated (either manually by the player or automatically when the maximum number of coins has been inserted), a signal is sent to a solenoid switch which causes the movable ledge 38 to slide inwardly allowing the playing disk 50 to drop into the top of each pachinko maze 30. The playing disk 50 falls through the pachinko maze 30 and comes to rest in one of the scoring slots 42. All of the playing disks 50 may be dropped simultaneously or a delay circuit or delay timer can be used which will stagger movement of the ledges 38 and thus stagger the dropping of each playing disk 50.

As the playing disk 50 enters the scoring slot 42, the playing disk 50 forces down a trip lever 46 which sends a signal to the electronic computer control identifying which of the scoring slots 42 for that particular pachinko maze 30 the playing disk 42 has fallen into. This electronic computer control causes the lighted symbol for that scoring slot 42 to switch from steady illumination to flashing illumination to additionally alert the player as to which scoring slot 42 the playing disk 50 has fallen into.

When the electronic computer control has recognized which combination of the scoring values has been achieved by the action of the playing disks 50 falling into particular scoring slots 42, the electronic computer control determines whether a winning combination has been achieved. If so, then a signal is sent to the coin hopper 18 to dispense the appropriate number of winning tokens. After the tokens have been dispensed (or if no winning combination has been achieved), the electronic computer control activates the disk moving unit 70 to move the playing disks 50 to their appropriate locations and thus prepare the apparatus for the next game and all the circuits are recycled back to the "ready" position. The game is now reset to accept tokens for the next game.

For each particular game, any combination of the value symbols 60 can be illuminated and therefore become active for the purpose of scoring. However, in the preferred embodiment, only one value symbol 60 of the three in each scoring slot 42 would be activated in any particular game.

In order to account for the different payoffs made to the player, the odds of the particular value symbols being illuminated in any particular game should not be equal. In the preferred embodiment, for any particular game, it is suggested that the six scoring slots 42 in maze 30A have illuminated three "cherries", two "plum"s and one "100" jackpot; the six scoring slots 42 in maze 30B have illuminated one "cherries", three "plum"s and two "100" jackpots; and the six scoring slots in maze 30C have illuminated three "cherries", two "plum" s and one "100" jackpot. (In order to give the illusion to the player that there are more combinations available than there actually are, which of the mazes is maze 30A, 30B and 30C can also be varied.) A typical illumination pattern of the value symbols 60 for the scoring slots 42 for each maze 30 is shown in FIG. 4. These combinations of active value symbols correspond to the payoff schedules shown above.

Appendix A sets out in detail the source code and programmer's comments to program a computer to operate this MULTI-SYMBOL MATCH 'EM pachinko game embodiment of the present invention. The illumination of one of the three particular value symbols 60 associated with each scoring slot 42 for any particular game is done purely randomly using the RNG to send a signal to the illumination bulb under the value symbol 60 to be activated. The winning and losing combinations are controlled by the RNG so that even if the playing disk 50 falls into the same scoring slot 42 every time, the randomness of the game will not be affected.

Other modifications could be made such as illuminating more than one value symbol 60 in some or all of the scoring slots 42. Alternatively in some of the scoring slots 42, none of the symbols could be illuminated. Either of these modifications would result in the odds of achieving a winning combination changing and different payout amounts would be required.

It is also possible to modify this game to provide for payoffs larger than 100 tokens. The game apparatus can be programmed to provide for an additional "free" game for the player if the player achieves a predetermined combination of symbols. For example, if the player would "hit" three "100" jackpots, instead of being paid 100 tokens, the player would be paid a lesser amount, say 50 tokens, and the player would receive a free game. During the free game, the gaming apparatus could be programmed to make all the winning combinations active or only some of the winning combinations active. For example, during the free game, the gaming apparatus could be programmed to only pay the player if the player "hits" another three "100" jackpots. Because the odds of the player "hitting" back to back three "100" jackpots would be quite high, a large payoff could be made.

This modification of giving the player a free game for certain winning combinations can also be applied to a conventional reel slot machine. If a player achieves one of certain designated combinations of the symbols on the reels of a slot machine, the player would win a free pull of the handle of the slot machine to attempt to increase his winnings. The slot machine would be set up so that the player must achieve certain winning combinations back to back in order to increase his winnings.

For example, the free pull of the handle of the slot machine could be activated if the player hits three jackpot symbols on a three reel slot machine. If the player again hits three jackpot symbols on his free pull, the player would win a large jackpot since the mathematical odds of achieving three jackpot symbols two games in a row could be quite high. This modification is not limited to back-to-back three jackpot symbols, but rather could be adjusted to provide for different payoffs for different types of consecutive winning combinations. This modification that requires a player to hit winning combinations back-to-back allows for larger payoffs than the player would win if the player were simply paid the usual amount for each winning combination separately.

Another particular modification that is suggested is a payoff schedule for a six token or six coin "buy" game.

The information blocks would have to be modified to show the player what the potential payoffs would be for this six coin "buy" game. In the preferred embodiment for a six coin "buy" game, a suggested payout schedule is as follows:

| symbol combination | # of tokens returned to player |
|---|---|
| I. Player wagers one token: | |
| two "cherries" | 2 |
| three "cherries" | 9 |
| II. Player wagers two tokens: | |
| three "plum"s | 17 |
| III. Player wagers three tokens: | |
| three "100" jackpots | 100 |
| IV. Player wagers four tokens: | |
| three "100" jackpots | 200 |
| V. Player wagers five tokens: | |
| three "100" jackpots | 300 |
| VI. Player wagers six tokens: | |
| three "100" jackpots | 400 |

The payoffs are cumulative, not exclusive, as described above. With regard to this six coin "buy" version, it is also recommended to change the value symbol illumination pattern from the pattern shown in FIG. 4. In this preferred embodiment for a six coin "buy" game, it is suggested that the six scoring slots 42 in maze 30A have illuminated two "cherries", two "plum"s and two "100" jackpots; the six scoring slots 42 in maze 30B have illuminated two "cherries", three "plum"s and one "100" jackpot; and the six scoring slots in maze 30C have illuminated three "cherries", two "plum"s and one "100" jackpot. (In order to give the illusion to the player that there are more combinations available than there actually are, which of the mazes is maze 30A, 30B and 30C can also be varied.)

Figure 6:
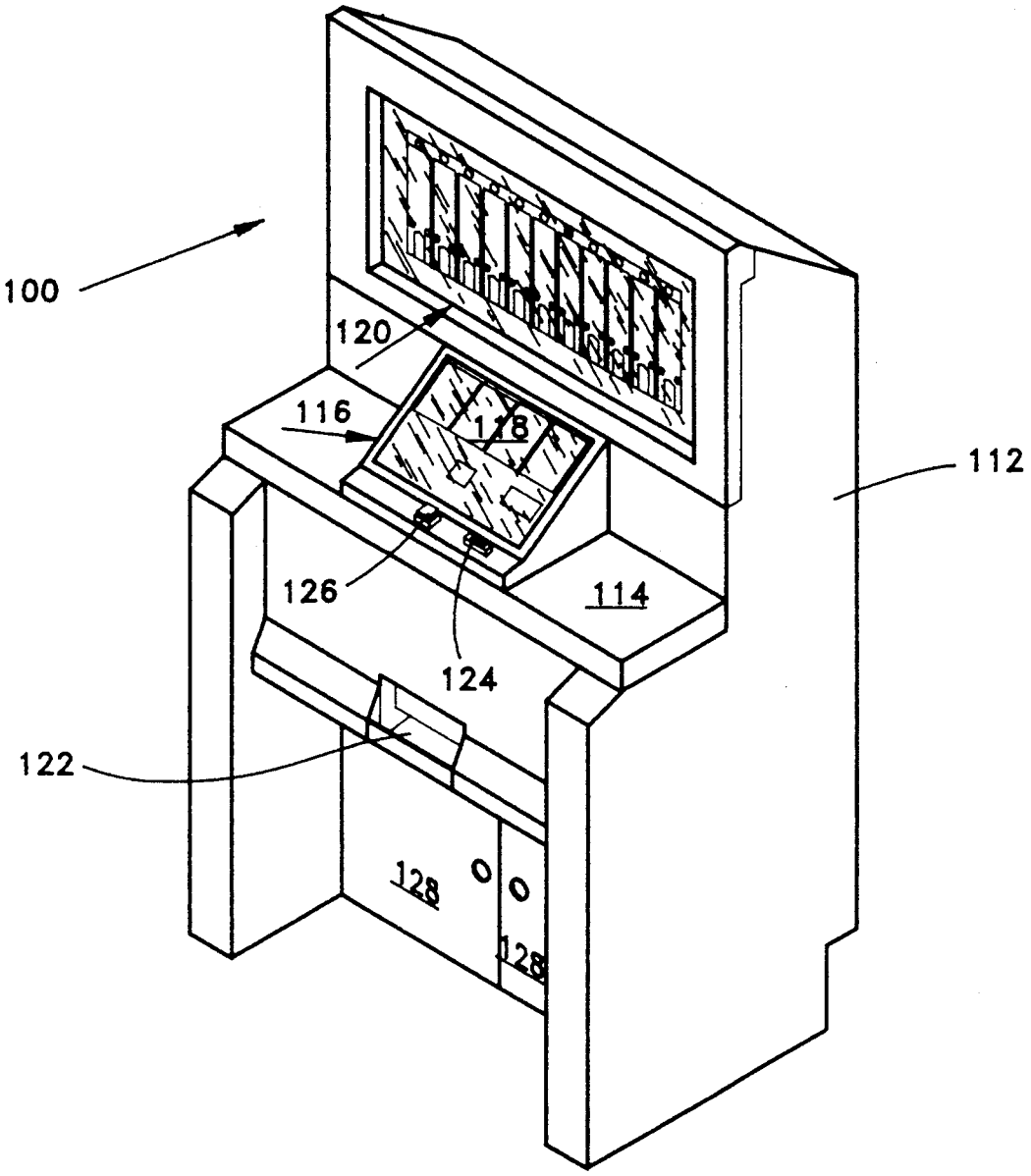
FIG. 6 shows a front view of an alternate embodiment of the gaming machine apparatus used to play the LEFT-RIGHT MATCH 'EM pachinko game of the present invention.
Figure 7:
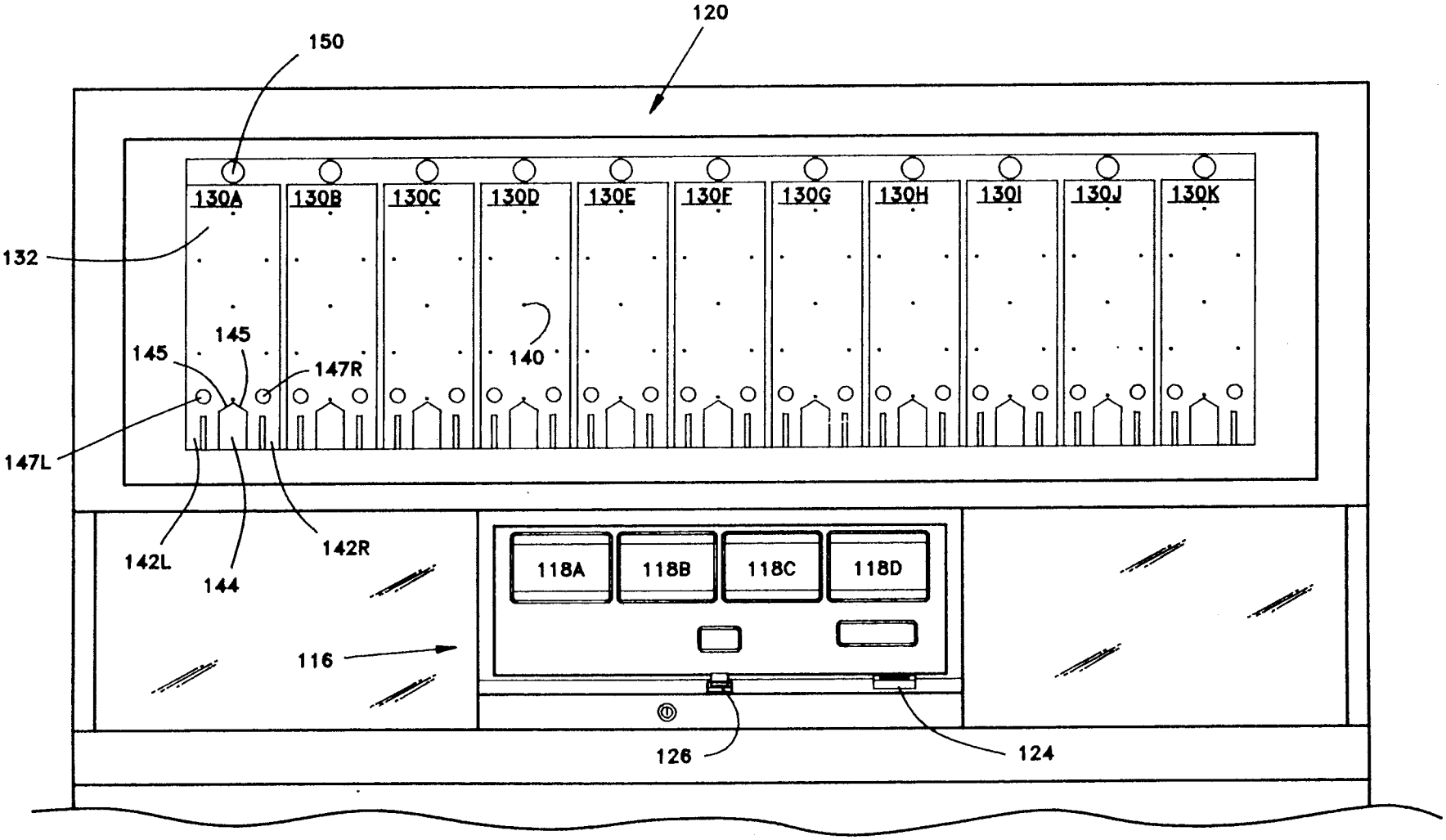
FIG. 7 shows a front view of an alternate embodiment of the playing field of the LEFT-RIGHT MATCH 'EM pachinko game of the present invention.

The second preferred embodiment of the present invention is shown in FIGS. 6 and 7. The gaming apparatus used to play the LEFT-RIGHT MATCH 'EM pachinko game of this second preferred embodiment is shown generally at 100 in FIG. 5. The apparatus comprises a generally upright cabinet 112, the approximate upper third of which houses the playing field shown generally at 120. Just below the playing field 120 on a horizontal shelf 114, there is a display panel 116 containing the display area 118 providing playing information to the user as well as the various buttons and meters which operate the game. At an appropriate location on the display panel 116, a coin acceptor slot 124 is provided to receive the coins or tokens that players insert to activate the game. Also at an appropriate location on the display panel 116 there is provided a button 126 for starting the game.

Below the playing field 120 and display panel 116, there is provided a coin tray 122 into which the coins or tokens are dispensed whenever the player wins. Below the coin tray 122, two lockable doors 128 conceal the internal area in the machine where coins or tokens that have been wagered are stored in a bucket in the coin drop area for removal at a later time.

On the interior of the gaming machine apparatus 100 there is also provided a coin acceptor cooperating with the coin acceptor slot 124, a coin hopper to receive and dispense coins or tokens, the power supply and the electronic control panel that contains the printed circuit boards and other electronic devices that control the operation of the game and the mechanical apparatus that moves the playing disks through the apparatus—all of the these items being similar to those used in the first preferred embodiment of the invention described in detail above in connection with FIGS. 1-5.

The playing field 120 and display area 116 are more clearly shown in FIG. 7. In this LEFT-RIGHT MATCH 'EM pachinko game embodiment of the invention, the playing field 120 has a plurality of identical pachinko mazes 130 side by side, only one of which will be described. In the preferred embodiment eleven pachinko mazes 130A-130K are provided, but the number of pachinko mazes 130 may be more or less than eleven.

Each pachinko maze 130 has a back wall 132 of preferably opaque material. Parallel to the back wall is a preferably transparent front wall (not shown) to allow the player to observe the fall of the playing disks 150. At the top of each pachinko maze 130, an opening similar to that shown in FIGS. 1-5 is provided through which a playing disk 150 is introduced into each pachinko maze 130. A plurality of deflection pins 140 or pegs are disposed between the back wall 132 and the front wall, each pin 140 being of a length approximately equal to the width between the back wall 132 and the front wall. This arrangement is similar to the arrangement for the pachinko mazes 30 described in connection with the first preferred MULTI-SYMBOL MATCH 'EM pachinko game embodiment shown in FIGS. 1-5.

At the lower end of each pachinko maze 130, two vertically disposed scoring slots 142 are provided designated the "left"slot 142L and the "right"slot 142R. The scoring slots 142 are separated from one another by a vertical spacer 144. The vertical spacer 144 has two upper slanted surfaces 145 to encourage the playing disk 150 to fall into either the left slot 142L or the right slot 142R. At the entrance to each scoring slot 142L or 142R, an illumination device 147L or 147R, such as a light bulb, is mounted in the back wall 132.

As is conventional in a pachinko game, when the playing disk 150 is introduced into the pachinko maze 130, the falling playing disk 150 bounces back and forth due to the playing disk 150 colliding with the deflection pins 140 as the playing disk 150 falls. Eventually the playing disk 150 will come to rest in either the right scoring slot 142R or the left scoring slot 142L. A mechanical lever (not shown), similar to the mechanical lever 46 shown in FIG. 3, is provided in each scoring slot 142 so that as the playing disk 150 passes into a particular scoring slot 142, the mechanical lever will be forced downwardly which will electronically send a signal to the computer control indicating which scoring slot 142L or 142R the playing disk 150 has fallen into.

When the player inserts the first token to begin the game, the computer control will select either the right scoring slot 142R or the left scoring slot 142L as the active scoring slot for that particular game. This selection is not shown to the player, however, until the player pushes the start button to cause the playing disks 150 to begin falling. Prior to the pushing of the start button, the light bulbs 147L and 147R are preferably set to flash on and off.

Once the playing disks 150 begin to fall, the light bulb corresponding to the active scoring slot is illuminated so that the player will be able to see if the playing disk 150 falls into the lighted active slot or the unlighted inactive slot. The vertical spacer 144 between the left scoring slot 142L and the right scoring slot 142R may be provided with its own illumination device that will also light up if the playing disk 150 falls into the active slot. The player need only count the number of vertical spacers 144 that are illuminated to determine how many matches the player has achieved.

The player wins if a predetermined number of playing disks 150 fall into the lighted active sides of the scoring slots 142. Any suitable scoring schedule can be used, but in the preferred embodiment of the present invention, the scoring values that the player receives is based on the number of tokens or coins that the player wagers prior to the start of the game. The scoring schedules can be displayed to the player using the display area 118.

This game can also be played as a "buy" game with the payoffs changing depending upon how many coins or tokens the player wagers. The following scoring schedules are recommended to give the gaming casino a reasonable return on the game:

| # of disks in a lighted slot | # of tokens returned to player |
|---|---|
| I. (Shown in display area 118A) Player wagers one token: | |
| 7 | 3 |
| 8 | 4 |
| 9 | 4 |
| 10 | 4 |
| 11 | 4 |
| II. (Shown in display area 118B) Player wagers two tokens: | |
| 7 | 3 |
| 8 | 11 |
| 9 | 15 |
| 10 | 15 |
| 11 | 15 |
| III. (Shown in display area 118C) Player wagers three tokens: | |
| 7 | 3 |
| 8 | 11 |
| 9 | 42 |
| 10 | 50 |
| 11 | 50 |
| IV. (Shown in display area 118D) Player wagers four tokens: | |
| 7 | 3 |
| 8 | 11 |
| 9 | 42 |
| 10 | 100 |
| 11 | 1000 |

There is nothing critical about the particular payoff schedule used.

In the operation of this LEFT-RIGHT MATCH 'EM embodiment of the game, the player inserts one, two, three or four tokens into the coin acceptor slot 124. When the first token is introduced into the coin acceptor, a sensor in the coin acceptor sends a signal through the electronic control to a conventional random number generator (RNG). The RNG has a plurality of numbers which are assigned to each of the scoring slots 147L and 147R in each of the pachinko mazes 130. The RNG has been continuously cycling through the possible number combinations, and when the RNG receives the signal from the coin acceptor, the RNG sends a signal to the symbol display unit to identify which of the pachinko mazes 130 will have the "right"slot 142R activated and which of the pachinko mazes 130 will have the "left"-slot 142L activated for that particular game.

When the player has completed entering the number of tokens he wishes to wager for that particular game and the player pushes the start button 126, the active side for each scoring slot 142 is illuminated. (Alternatively and as is conventional in many electronic gaming devices, when the player has inserted the maximum number of coins, in this case four, the game is begun automatically without the necessity of the player manually pressing the start button.)

Also when the first token is deposited in the coin acceptor, the playing disks 150 from the previous game are ejected from the scoring slots 142. This is achieved using the same type of disk moving system that was described above in connection with FIG. 5, with the only modification being that the playing disks 150 move in groups of eleven disks instead of three disks. This mechanical activity is activated by having a signal sent from the coin acceptor to the disk moving system which causes the peg in the bottom of each scoring slot 142 to slide inwardly allowing the playing disk 150 to fall downwardly, guided by an extension of the vertical spacer 144, out of the scoring slot 142 and into operative relation with the chain link and track. The ejected playing disks 150 are returned to the top of the pachinko mazes 130 by means of the disk moving system described above in connection with FIG. 5. In this preferred embodiment of the present invention, thirty-three disks are used so that there are always eleven playing disks 150 at the top of the pachinko mazes 130 ready to be dropped.

When the start button 126 is activated (either manually by the player or automatically when the maximum number of coins has been inserted), a signal is sent to a movable ledge (similar to the movable ledge 38 shown in FIG. 3) which allows one playing disk 150 to drop into the top of each pachinko maze 130. The playing disks 150 can either be dropped simultaneously or in a staggered manner.

The playing disk 150 falls through the pachinko maze 130 and comes to rest in either the right scoring slot 142R or the left scoring slot 142L. As the playing disk 150 enters the scoring slot 142R or 142L, the playing disk 150 forces down a trip lever which sends a signal to the electronic computer control identifying which of the scoring slots 142L or 142R for that particular maze 130 the playing disk 150 has fallen into. This electronic computer control causes the lighted symbol on the vertical spacer 144 to begin flashing at each scoring slot 142 in which a playing disk 150 has fallen into the lighted side.

When the electronic computer control has recognized how many playing disks 150 have fallen into active lighted scoring slots 142, the electronic computer control determines whether a winning number has been achieved. If so, then a signal is sent to the coin hopper to dispense the appropriate number of winning tokens into the coin tray 122. After the tokens have been dispensed (or if no winning combination has been achieved), the electronic computer control activates the disk moving unit to prepare the apparatus for the next game and all the circuits are recycled back to the "ready" position. The game is now reset to accept tokens for the next game.

Appendix B sets out in detail the source code and programmer's comments to program a computer to operate this LEFT-RIGHT MATCH 'EM pachinko game embodiment of the present invention. The illumination of either the left or the right side of each scoring slot 142 for any particular game is done purely randomly using the RNG to send a signal to the illumination bulb associated with the side of the scoring slot to be activated. The winning and losing combinations are controlled by the RNG so that even if the playing disk 150 falls into the same side of the scoring slot 142 every time, the randomness of the game will not be affected.

While the invention has been illustrated with respect to several specific embodiments thereof, these embodiments should be considered as illustrative rather than limiting. Various modifications and additions may be made and will be apparent to those skilled in the art.

Accordingly, the invention should not be limited by the foregoing description, but rather should be defined only by the following claims.

What is claimed is:

1. A method of playing a game comprising:

(a) providing a vertical playing field having at least one pachinko maze comprising a back wall and a front wall, a plurality of deflection pins disposed at right angles to the back wall and extending approximately to the front wall, a plurality of scoring slots at a lower end of the playing field and at least one opening for inserting a playing disk at a top end of the playing field, (b) inserting at least one playing disk in the top opening, (c) allowing the disk to fall by gravity through the deflection pins and into a scoring slot, (d) allocating a value for each scoring slot for a particular game and randomly varying the value allocated to each scoring slot from game to game, and (e) determining the score for a particular game from the value given to the scoring slot in which the disk comes to rest in that particular game.

2. The method of claim 1 wherein the player can observe the fall of the playing disk through the front wall of the playing field.

3. The method of claim 1 wherein the score achieved by the player has monetary value and each game is activated by a player inserting at least one gaming token.

4. The method of claim 3 wherein when the player achieves a winning score, he receives at least one gaming token.

5. The method of claim 1 wherein the value for each scoring slot is allocated by a random number generator.

6. The method of claim 1 wherein each scoring slot is designated with at least one value symbol displaying the value allocated to that slot.

7. The method of claim 6 wherein the value symbol is a "cherries"symbol, a "plum"symbol or a "100" jackpot symbol.

8. The method of claim 1 wherein the playing field has a plurality of parallel pachinko mazes, each having a playing disk associated therewith.

9. The method of claim 8 wherein each pachinko maze has a plurality of scoring slots.

10. The method of claim 9 wherein the number of scoring slots is six.

11. The method of claim 9 wherein each scoring slot is designated with at least one value symbol displaying the value allocated to that slot.

12. The method of claim 11 wherein the scoring symbol is a "cherries"symbol, a "plum"symbol or a "100" jackpot symbol.

13. The method of claim 12 wherein the player achieves a preselected score depending on which combination of symbols are designated in the scoring slots that the three disks fall into.

14. The method of claim 13 wherein the game is activated by the player inserting tokens and the preselected score further depends on the number of tokens that the player has inserted.

15. The method of claim 14 wherein the number of pachinko mazes is three and the preselected score is determined from the following table:

(a) if the player inserts one token:
  (1) the player wins 2 tokens if he achieves 2 "cherries"
  (2) the player wins 9 tokens if he achieves 3 "cherries";

(b) if the player inserts two tokens:
  (1) the player wins 2 tokens if he achieves 2 "cherries"
  (2) the player wins 9 tokens if he achieves 3 "cherries"
  (3) the player wins 17 tokens if achieves 3 "plums";

(c) if the player inserts three tokens:
  (1) the player wins 2 tokens if he achieves 2 "cherries"
  (2) the player wins 9 tokens if he achieves 3 "cherries"
  (3) the player wins 17 tokens if he achieves 3 "plums"
  (4) the player wins 100 tokens if he achieves 3 "100" jackpots.

16. The method of claim 14 wherein the number of pachinko mazes is three and the preselected score is determined from the following table:

(a) if the player inserts one token:
  (1) the player wins 2 tokens if he achieves 2 "cherries"
  (2) the player wins 9 tokens if he achieves 3 "cherries";

(b) if the player inserts two tokens:
  (1) the player wins 2 tokens if he achieves 2 "cherries"
  (2) the player wins 9 tokens if he achieves 3 "cherries"
  (3) the player wins 17 tokens if achieves 3 "plums";

(c) if the player inserts three tokens:
  (1) the player wins 2 tokens if he achieves 2 "cherries"
  (2) the player wins 9 tokens if he achieves 3 "cherries"
  (3) the player wins 17 tokens if he achieves 3 "plums"
  (4) the player wins 100 tokens if he achieves 3 "100" jackpots;

(d) if the player inserts four tokens:
  (1) the player wins 2 tokens if he achieves 2 "cherries"
  (2) the player wins 9 tokens if he achieves 3 "cherries"
  (3) the player wins 17 tokens if he achieves 3 "plums"
  (4) the player wins 200 tokens if he achieves 3 "100" jackpots;

(e) if the player inserts five tokens:
  (1) the player wins 2 tokens if he achieves 2 "cherries"
  (2) the player wins 9 tokens if he achieves 3 "cherries"
  (3) the player wins 17 tokens if he achieves 3 "plums"
  (4) the player wins 300 tokens if he achieves 3 "100" jackpots;

(f) if the player inserts six tokens:
  (1) the player wins 2 tokens if he achieves 2 "cherries"

(2) the player wins 9 tokens if he achieves 3 "cherries"

(3) the player wins 17 tokens if he achieves 3 "plums"

(4) the player wins 400 tokens if he achieves 3 "100" jackpots.

17. The method of claim 13 wherein if the player achieves a predetermined combination of a preselected group of winning value symbols the player wins a free game with the chance to increase his score.

18. The method of claim 17 wherein during the play of the free game not all winning value symbols are active.

19. The method of claim 18 wherein the predetermined combination for winning a free game is three "100" jackpots and the winning value symbols that are active during the free game are only the "100" jackpot symbols.

20. The method of claim 8 wherein each pachinko maze has two scoring slots.

21. The method of claim 20 wherein each scoring slot is designated with at least one value symbol allocating a value to that slot.

22. The method of claim 21 wherein the two scoring slots are designated with the symbols "right" and "left", respectively.

23. The method of claim 22 wherein the player achieves a preselected score depending on the number of disks that fall into designated scoring slots.

24. The method of claim 23 wherein the designation of the scoring slot is done by a random number generator.

25. The method of claim 24 wherein the game is activated by the player wagering at least one token.

26. The method of claim 25 wherein the number of pachinko mazes is eleven and the preselected score is determined from the following table:

| # of disks in a lighted slot | # of tokens returned to player |
|---|---|
| I. Player wagers one token: | |
| 7 | 3 |
| 8 | 4 |
| 9 | 4 |
| 10 | 4 |
| 11 | 4 |
| II. Player wagers two tokens: | |
| 7 | 3 |
| 8 | 11 |
| 9 | 15 |
| 10 | 15 |
| 11 | 15 |
| III. Player wagers three tokens: | |
| 7 | 3 |
| 8 | 11 |
| 9 | 42 |
| 10 | 50 |
| 11 | 50 |
| I. Player wagers four tokens: | |
| 7 | 3 |
| 8 | 11 |
| 9 | 42 |
| 10 | 100 |
| 11 | 1000 |

27. A method of playing a game comprising (a) providing a playing field having a plurality of scoring slots associated with the playing field and at least one opening for inserting a playing disk into the playing field, (b) inserting at least one playing disk into the playing field, (c) allowing the disk to come to rest in a scoring slot, (d) allocating a value for each scoring slot for a particular game and randomly varying the value allocated to each scoring slot from game to game, and (e) determining the score for a particular game from the value given to the scoring slot in which the disk comes to rest in that particular game.

28. The method of claim 27 wherein the playing field is a pachinko maze.

29. The method of claim 28 wherein the score achieved by the player has monetary value and each game is activated by a player inserting at least one gaming token.

30. The method of claim 29 wherein when the player achieves a winning score, he receives at least one gaming token.

31. The method of claim 28 wherein the value for each scoring slot is allocated by a random number generator.

32. The method of claim 29 wherein each scoring slot is designated with at least one value symbol displaying the value allocated to that slot.

33. The method of claim 32 wherein the value symbol is a "cherries" symbol, a "plum" symbol or a "100" jackpot symbol.

34. The method of claim 28 wherein the playing field has a plurality of parallel pachinko mazes, each having a playing disk associated therewith.

35. The method of claim 34 wherein each pachinko maze has a plurality of scoring slots.

36. The method of claim 35 wherein the number of scoring slots is six.

37. The method of claim 35 wherein each scoring slot is designated with at least one value symbol displaying the value allocated to that slot.

38. The method of claim 37 wherein the scoring symbol is a "cherries" symbol, a "plum" symbol or a "100" jackpot symbol.

39. The method of claim 38 wherein the player achieves a preselected score depending on which combination of symbols are designated in the scoring slots that the disks fall into.

40. The method of claim 39 wherein the game is activated by the player inserting tokens and the preselected score further depends on the number of tokens that the player has inserted.

41. The method of claim 40 wherein the number of pachinko mazes is three and the preselected score is determined from the following table:

(a) if the player inserts one token:

(1) the player wins 2 tokens if he achieves 2 "cherries"

(2) the player wins 9 tokens if he achieves 3 "cherries";

(b) if the player inserts two tokens:

(1) the player wins 2 tokens if he achieves 2 "cherries"

(2) the player wins 9 tokens if he achieves 3 "cherries"

(3) the player wins 17 tokens if achieves 3 "plums";

(c) if the player inserts three tokens;

(1) the player wins 2 tokens if he achieves 2 "cherries"

(2) the player wins 9 tokens if he achieves 3 "cherries"

(3) the player wins 17 tokens if he achieves 3 "plums"

(4) the player wins 100 tokens if he achieves 3 "100" jackpots.

42. The method of claim 40 wherein the number of pachinko mazes is three and the preselected score is determined from the following table:

(a) if the player inserts one token:

(1) the player wins 2 tokens if he achieves 2 "cherries"

(2) the player wins 9 tokens if he achieves 3 "cherries";

(b) if the player inserts two tokens:

(1) the player wins 2 tokens if he achieves 2 "cherries"

(2) the player wins 9 tokens if he achieves 3 "cherries"

(3) the player wins 17 tokens if achieves 3 "plums";

(c) if the player inserts three tokens:

(1) the player wins 2 tokens if he achieves 2 "cherries"

(2) the player wins 9 tokens if he achieves 3 "cherries"

(3) the player wins 17 tokens if he achieves 3 "plums"

(4) the player wins 100 tokens if he achieves 3 "100" jackpots;

(d) if the player inserts four tokens:

(1) the player wins 2 tokens if he achieves 2 "cherries"

(2) the player wins 9 tokens if he achieves 3 "cherries"

(3) the player wins 17 tokens if he achieves 3 "plums"

(4) the player wins 200 tokens if he achieves 3 "100" jackpots;

(e) if the player inserts five tokens:

(1) the player wins 2 tokens if he achieves 2 "cherries"

(2) the player wins 9 tokens if he achieves 3 "cherries"

(3) the player wins 17 tokens if he achieves 3 "plums"

(4) the player wins 300 tokens if he achieves 3 "100"jackpots;

(f) if the player inserts six tokens:

(1) the player wins 2 tokens if he achieves 2 "cherries"

(2) the player wins 9 tokens if he achieves 3 "cherries"

(3) the player wins 17 tokens if he achieves 3 "plums"

(4) the player wins 400 tokens if he achieves 3 "100" jackpots;

43. The method of claim 39 wherein if the player achieves a predetermined combination of a preselected group of winning value symbols the player wins a free game with the chance to increase his score.

44. The method of claim 43 wherein during the play of the free game not all winning value symbols are active.

45. The method of claim 44 wherein the predetermined combination for winning a free game is three "100" jackpots and the winning value symbols that are active during the free game are only the "100" jackpot symbols.

46. The method of claim 34 wherein each pachinko maze has two scoring slots.

47. The method of claim 46 wherein each scoring slot is designated with at least one value symbol allocating a value to that slot.

48. The method of claim 47 wherein the two scoring slots are designated with the symbols "right" and "left", respectively.

49. The method of claim 48 wherein the player achieves a preselected score depending on the number of disks that fall into designated scoring slots.

50. The method of claim 49 wherein the designation of the scoring slot is done by a random number generator.

51. The method of claim 50 wherein the game is activated by the player wagering at least one token.

52. The method of claim 51 wherein the number of pachinko mazes is eleven and the preselected score is determined from the following table:

| # of disks in a lighted slot | # of tokens returned to player |
|---|---|
| I. Player wagers one token: | |
| 7 | 3 |
| 8 | 4 |
| 9 | 4 |
| 10 | 4 |
| 11 | 4 |
| II. Player wagers two tokens: | |
| 7 | 3 |
| 8 | 11 |
| 9 | 15 |
| 10 | 15 |
| 11 | 15 |
| III. Player wagers three tokens: | |
| 7 | 3 |
| 8 | 11 |
| 9 | 42 |
| 10 | 50 |
| 11 | 50 |
| IV. Player wagers four tokens: | |
| 7 | 3 |
| 8 | 11 |
| 9 | 42 |
| 10 | 100 |
| 11 | 1000 |

53. The method of playing a game comprising:

(a) randomly selecting at least one symbol from a plurality of symbols, (b) determining whether the selected symbol is a winning symbol, (c) if the symbol is a winning symbol, awarding a free play of the game, (d) determining whether a winning symbol is achieved during the free play, and (e) if the symbol achieved during the free play is a winning symbol, awarding the player a larger payoff for achieving winning symbols back-to-back than the payoff the player would have theoretically received if he achieved the winning symbols in two consecutive but separate games.

54. A game apparatus comprising:

(a) a vertical playing field having a back wall and a front wall, (b) at least one pachinko maze disposed within the playing field and having a plurality of deflection pins disposed between the back wall and the front wall, (c) an opening for inserting a playing disk at an upper end of the pachinko maze, (d) a plurality of scoring slots at a lower end of the pachinko maze,
(e) each of the scoring slots having at least one value symbol designating a particular value associated with the scoring slot for a particular game, and
(f) means for randomly varying the value symbol whereby different values for each scoring slot are designated from game to game.

55. The game apparatus of claim 54 wherein a plurality of pachinko mazes are provided.

56. The game apparatus of claim 55 wherein the value symbol is a lighted symbol that is either on or off.

57. The game apparatus of claim 56 wherein eleven pachinko mazes are arranged side by side.

58. The game apparatus of claim 55 wherein the value symbol is a lighted symbol selected from a plurality of symbols.

59. The game apparatus of claim 58 wherein the symbol can be a "cherries", a "plum" or a "100" jackpot.

60. The game apparatus of claim 59 wherein three pachinko mazes are arranged side by side.

61. A game apparatus comprising:
(a) a playing field,
(b) at least one pachinko maze disposed within the playing field,
(c) means for inserting a playing disk into the pachinko maze,
(d) a plurality of scoring slots disposed within the pachinko maze,
(e) each of the scoring slots having at least one value symbol designating a particular value associated with the scoring slot for a particular game, and
(f) means for randomly varying the value symbol whereby different values for each scoring slot are designated from game to game.

62. The game apparatus of claim 61 wherein a plurality of pachinko mazes are provided.

63. The game apparatus of claim 62 wherein the value symbol is a lighted symbol that is either on or off.

64. The game apparatus of claim 63 wherein eleven pachinko mazes are arranged side by side.

65. The game apparatus of claim 62 wherein the value symbol is a lighted symbol selected from a plurality of symbols.

66. The game apparatus of claim 65 wherein the symbol can be a "cherries", a "plum" or a "100" jackpot.

67. The game apparatus of claim 66 wherein three pachinko mazes are arranged side by side.

68. A method of playing a game comprising:
(a) providing a vertical playing field having at least one pachinko maze comprising a back wall and a front wall, a plurality of deflection pins disposed at right angles to the back wall and extending approximately to the front wall, a plurality of scoring slots at a lower end of the playing field and at least one opening for inserting a playing disk at a top end of the playing field,
(b) inserting at least one playing disk in the top opening,
(c) allowing the disk to fall by gravity through the deflection pins and into a scoring slot,
(d) allocating by using a random number generator a value for each scoring slot and varying the value allocated to each scoring slot from game to game, and
(e) determining the score for a particular game from the value given to the scoring slot in which the disk comes to rest in that particular game.

69. A method of playing a game comprising:
(a) providing a vertical playing field having a plurality of parallel pachinko mazes,
(b) each pachinko maze comprising a back wall and a front wall, a plurality of deflection pins disposed at right angles to the back wall and extending approximately to the front wall, a plurality of scoring slots at a lower end of the playing field and at least one opening for inserting a playing disk at a top end of the playing field, and each pachinko maze having at least one playing disk associated therewith,
(c) inserting at least one playing disk in the top opening of each pachinko maze,
(d) allowing the disk to fall by gravity through the deflection pins and into a scoring slot,
(e) allocating a value for each scoring slot and varying the value allocated to each scoring slot from game to game, and
(f) determining the score for a particular game from the value given to the scoring slot in which the disk comes to rest in that particular game.

70. The method of claim 69 wherein each pachinko maze has a plurality of scoring slots.

71. The method of claim 70 wherein the number of scoring slots is six.

72. The method of claim 70 wherein each scoring slot is designated with at least one value symbol displaying the value allocated to that slot.

73. The method of claim 72 wherein the scoring symbol is a "cherries" symbol, a "plum" symbol or a "100" jackpot symbol.

74. The method of claim 73 wherein the player achieves a preselected score depending on which combination of symbols are designated in the scoring slots that the disks fall into.

75. The method of claim 74 wherein the game is activated by the player inserting tokens and the preselected score further depends on the number of tokens that the player has inserted.

76. The method of claim 75 wherein the number of pachinko mazes is three and the preselected score is determined from the following table:
(a) if the player inserts one token:
(1) the player wins 2 tokens if he achieves 2 "cherries"
(2) the player wins 9 tokens if he achieves 3 "cherries";
(b) if the player inserts two tokens;
(1) the player wins 2 tokens if he achieves 2 "cherries"
(2) the player wins 9 tokens if he achieves 3 "cherries"
(3) the player wins 17 tokens if achieves 3 "plums";
(c) if the player inserts three tokens:
(1) the player wins 2 tokens if he achieves 2 "cherries"
(2) the player wins 9 tokens if he achieves 3 "cherries"
(3) the player wins 17 tokens if he achieves 3 "plums"
(4) the player wins 100 tokens if he achieves 3 "100" jackpots.

77. The method of claim 75 wherein the number of pachinko mazes is three and the preselected score is determined from the following table:
(a) if the player inserts one token:
(1) the player wins 2 tokens if he achieves 2 "cherries"

(2) the player wins 9 tokens if he achieves 3 "cherries";

(b) if the player inserts two tokens:

(1) the player wins 2 tokens if he achieves 2 "cherries"

(2) the player wins 9 tokens if he achieves 3 "cherries"

(3) the player wins 17 tokens if he achieves 3 "plums"

(c) if the player inserts three tokens:

(1) the player wins 2 tokens if he achieves 2 "cherries"

(2) the player wins 9 tokens if he achieves 3 "cherries"

(3) the player wins 17 tokens if he achieves 3 "plums"

(4) the player wins 100 tokens if he achieves 3 "100" jackpots;

(d) if the player inserts four tokens:

(1) the player wins 2 tokens if he achieves 2 "cherries"

(2) the player wins 9 tokens if he achieves 3 "cherries"

(3) the player wins 17 tokens if he achieves 3 "plums"

(4) the player wins 200 tokens if he achieves 3 "100" jackpots;

(e) if the player inserts five tokens:

(1) the player wins 2 tokens if he achieves 2 "cherries"

(2) the player wins 9 tokens if he achieves 3 "cherries"

(3) the player wins 17 tokens if he achieves 3 "plums"

(4) the player wins 300 tokens if he achieves 3 "100" jackpots;

(f) if the player inserts six tokens:

(1) the player wins 2 tokens if he achieves 2 "cherries"

(2) the player wins 9 tokens if he achieves 3 "cherries"

(3) the player wins 17 tokens if he achieves 3 "plums"

(4) the player wins 400 tokens if he achieves 3 "100" jackpots.

78. The method of claim 74 wherein if the player achieves a predetermined combination of a preselected group of winning value symbols the player wins a free game with the chance to increase his score.

79. The method of claim 78 wherein during the play of the free game not all winning value symbols are active.

80. The method of claim 79 wherein the predetermined combination for winning a free game is three "100" jackpots and the winning value symbols that are active during the free game are only the "100" jackpot symbols.

81. The method of claim 69 wherein each pachinko maze has two scoring slots.

82. The method of claim 81 wherein each scoring slot is designated with at least one value symbol allocating a value to that slot.

83. The method of claim 82 wherein the two scoring slots are designated with the symbols "right" and "left", respectively.

84. The method of claim 83 wherein the player achieves a preselected score depending on the number of disks that fall into designated scoring slots.

85. The method of claim 84 wherein the designation of the scoring slot is done by a random number generator.

86. The method of claim 85 wherein the game is activated by the player wagering at least one token.

87. The method of claim 86 wherein the number of pachinko mazes is eleven and the preselected score is determined from the following table:

| # of disks in a lighted slot | # of tokens returned to player |
|---|---|
| I. Player wagers one token: | |
| 7 | 3 |
| 8 | 4 |
| 9 | 4 |
| 10 | 4 |
| 11 | 4 |
| II. Player wagers two tokens: | |
| 7 | 3 |
| 8 | 11 |
| 9 | 15 |
| 10 | 15 |
| 11 | 15 |
| III. Player wagers three tokens: | |
| 7 | 3 |
| 8 | 11 |
| 9 | 42 |
| 10 | 50 |
| 11 | 50 |
| I. Player wagers four tokens: | |
| 7 | 3 |
| 8 | 11 |
| 9 | 42 |
| 10 | 100 |
| 11 | 1000 |

88. A method of playing a game comprising:

(a) providing a playing field having a plurality of scoring slots associated with the playing field and at least one opening for inserting a playing disk into the playing field, (b) inserting at least one playing disk into the playing field, (c) allowing the disk to come to rest in a scoring slot, (d) allocating by using a random number generator a value for each scoring slot and varying the value allocated to each scoring slot from game to game, and (e) determining the score for a particular game from the value given to the scoring slot in which the disk comes to rest in that particular game.

89. A method of playing a game comprising:

(a) providing a playing field having a plurality of parallel pachinko mazes, (b) each pachinko maze having a plurality of scoring slots associated therewith and having at least one opening for inserting a playing disk into each pachinko maze, (b) inserting at least one playing disk into the playing field, (c) allowing the disk to come to rest in a scoring slot, (d) allocating a value to for each scoring slot and varying the value allocated to each scoring slot from game to game, and (e) determining the score for a particular game from the value given to the scoring slot in which the disk comes to rest in that particular game.

90. The method of claim 89 wherein the number of scoring the slots is six.

91. The method of claim 89 wherein each scoring slot is designated with at least one value symbol displaying the value allocated to that slot.

92. The method of claim 91 wherein the scoring symbol is a "cherries" symbol, a "plum" symbol or a "100" jackpot symbol.

93. The method of claim 92 wherein the player achieves a preselected score depending on which combination of symbols are designated in the scoring slots that the disks fall into.

94. The method of claim 93 wherein the game is activated by the player inserting tokens and the preselected score further depends on then number of tokens that the player has inserted.

95. The method of claim 94 wherein the number of pachinko mazes is three and the preselected score is determined from the following table:

(a) if the player inserts one token:
  (1) the player wins 2 tokens if he achieves 2 "cherries"
  (2) the player wins 9 tokens if he achieves 3 "cherries"
(b) if the player inserts two tokens:
  (1) the player wins 2 tokens if he achieves 2 "cherries"
  (2) the player wins 9 tokens if he achieves 3 "cherries"
  (3) the player wins 17 tokens if he achieves 3 "plums"
(c) if the player inserts three tokens:
  (1) the player wins 2 tokens if he achieves 2 "cherries"
  (2) the player wins 9 tokens if he achieves 3 "cherries"
  (3) the player wins 17 tokens if he achieves 3 "plums"
  (4) the player wins 100 tokens if he achieves 3 "100" jackpots.

96. The method of claim 94 wherein the number of pachinko mazes is three and the preselected score is determined from the following table:

(a) if the player inserts one token:
  (1) the player wins 2 tokens if he achieves 2 "cherries"
  (2) the player wins 9 tokens if he achieves 3 "cherries"
(b) if the player inserts two tokens:
  (1) the player wins 2 tokens if he achieves 2 "cherries"
  (2) the player wins 9 tokens if he achieves 3 "cherries"
  (3) the player wins 17 tokens if he achieves 3 "plums"
(c) if the player inserts three tokens:
  (1) the player wins 2 tokens if he achieves 2 "cherries"
  (2) the player wins 9 tokens if he achieves 3 "cherries"
  (3) the player wins 17 tokens if he achieves 3 "plums"
  (4) the player wins 100 tokens if he achieves 3 "100" jackpots;
(d) if the player inserts four tokens:
  (1) the player wins 2 tokens if he achieves 2 "cherries"
  (2) the player wins 9 tokens if he achieves 3 "cherries"
  (3) the player wins 17 tokens if he achieves 3 "plums"
  (4) the player wins 200 tokens if he achieves 3 "100" jackpots;
(e) if the player inserts five tokens:
  (1) the player wins 2 tokens if he achieves 2 "cherries"
  (2) the player wins 9 tokens if he achieves 3 "cherries"
  (3) the player wins 17 tokens if he achieves 3 "plums"
  (4) the player wins 300 tokens if he achieves 3 "100" jackpots;
(f) if the player inserts six tokens:
  (1) the player wins 2 tokens if he achieves 2 "cherries"
  (2) the player wins 9 tokens if he achieves 3 "cherries"
  (3) the player wins 17 tokens if he achieves 3 "plums"
  (4) the player wins 400 tokens if he achieves 3 "100" jackpots.

97. The method of claim 93 wherein if the player achieves a predetermined combination of a preselected group of winning value symbols the player wins a free game with the chance to increase his score.

98. The method of claim 97 wherein during the play of the free game not all winning value symbols are active.

99. The method of claim 98 wherein the predetermined combination for winning a free game is three "100" jackpots and the winning value symbols that are active during the free game are only the "100" jackpot symbols.

100. The method of claim 89 wherein each pachinko maze has two scoring slots.

101. The method of claim 100 wherein each scoring slot is designated with at least one value symbol allocating a value to that slot.

102. The method of claim 101 wherein the two scoring slots are designated with the symbols "right" and "left", respectively.

103. The method of claim 102 wherein the player achieves a preselected score depending on the number of disks that fall into designated scoring slots.

104. The method of claim 103 wherein the designation of the scoring slot is done by a random number generator.

105. The method of claim 104 wherein the game is activated by the player wagering at least one token.

106. The method of claim 105 wherein the number of pachinko mazes is eleven and the preselected score is determined from the following table:

| # of disks in a lighted slot | # of tokens returned to player |
|---|---|
| I. Player wagers one token: | |
| 7 | 3 |
| 8 | 4 |
| 9 | 4 |
| 10 | 4 |
| 11 | 4 |
| II. Player wagers two tokens: | |
| 7 | 3 |
| 8 | 11 |
| 9 | 15 |
| 10 | 15 |
| 11 | 15 |
| III. Player wagers three tokens: | |

-continued

| # of disks in a lighted slot | # of tokens returned to player |
|---|---|
| 7 | 3 |
| 8 | 11 |
| 9 | 42 |
| 10 | 50 |
| 11 | 50 |
| IV. Player wagers four tokens: | |
| 7 | 3 |
| 8 | 11 |
| 9 | 42 |
| 10 | 100 |
| 11 | 1000 |

107. A game apparatus comprising:

(a) a vertical playing field having a back wall and a front wall, (b) a plurality of pachinko mazes disposed within the playing field, each pachinko maze having a plurality of deflection pins disposed between the back wall and the front wall, (c) an opening for inserting a playing disk at an upper end of each pachinko maze, (d) a plurality of scoring slots at a lower end of each pachinko maze, (e) each of the scoring slots having at least one value symbol designating a particular value associated with the scoring slot, and (f) means for varying the value symbol whereby different values for each scoring slot are designated from game to game.

108. The game apparatus of claim 107 wherein the value symbol is a lighted symbol that is either on or off.

109. The game apparatus of claim 108 wherein eleven pachinko mazes are arranged side by side.

110. The game apparatus of claim 107 wherein the value symbol is a lighted symbol selected from a plurality of symbols.

111. The game apparatus of claim 110 wherein the symbol can be a "cherries", a "plum" or a "100" jackpot.

112. The game apparatus of claim 111 wherein three pachinko mazes are arranged side by side.

113. A game apparatus comprising:

(a) a playing field (b) a plurality of pachinko mazes disposed within the playing field, (c) means for inserting a playing disk into each pachinko maze, (d) a plurality of scoring slots disposed within each pachinko maze, (e) each of the scoring slots having at least one value symbol designating a particular value associated with the scoring slot, and (f) means for varying the value symbol whereby different values for each scoring slot are designated from game to game.

114. The game apparatus of claim 113 wherein the value symbol is a lighted symbol that is either on or off.

115. The game apparatus of claim 114 wherein eleven pachinko mazes are arranged side by side.

116. The game apparatus of claim 113 wherein the value symbol is a lighted symbol selected from a plurality of symbols.

117. The game apparatus of claim 116 wherein the symbol can be a "cherries", a "plum" or a "100" jackpot.

118. The game apparatus of claim 117 wherein three pachinko mazes ar arranged side by side.

* * * * *